United States Patent [19]

Yamamoto et al.

[11] Patent Number: 4,992,834

[45] Date of Patent: Feb. 12, 1991

[54] CLEANING BLADE ARRANGEMENT FOR IMAGE FORMING APPARATUS

[75] Inventors: Akira Yamamoto, Zama; Takahisa Yamada, Sagamihara; Tadashi Nishio, Hino; Kazuo Noda, Tokyo, all of Japan

[73] Assignee: Olympus Optical Co., Ltd., Tokyo, Japan

[21] Appl. No.: 283,608

[22] Filed: Dec. 13, 1988

[30] Foreign Application Priority Data

Dec. 21, 1987 [JP] Japan ..... 62-321431

[51] Int. Cl.[5] ..... G03G 21/00

[52] U.S. Cl. ..... 355/299; 15/256.5

[58] Field of Search ..... 355/299, 212; 118/652; 15/256.5, 256.51

[56] References Cited

U.S. PATENT DOCUMENTS

| | | | |
|---|---|---|---|
| Re. 30,924 | 5/1982 | Katayama et al. | 15/256.51 |
| 3,936,183 | 2/1976 | Sadamatsu | 15/256.5 X |
| 4,757,471 | 7/1988 | Fukae et al. | 355/212 |
| 4,758,862 | 7/1988 | Fukae et al. | 355/319 |

FOREIGN PATENT DOCUMENTS

| | | | |
|---|---|---|---|
| 62-972 | 1/1987 | Japan | 355/212 |
| 62-108276 | 5/1987 | Japan | 355/299 |

*Primary Examiner*—Joan H. Pendegrass

*Attorney, Agent, or Firm*—Frishauf, Holtz, Goodman & Woodward

[57] ABSTRACT

An image forming apparatus includes an image carrier rotatably disposed in a main body and having an image carrier surface, a transfer unit for transferring a toner image formed on the image carrier surface to a recording member, and a cleaning blade located in a downstream side of the transfer unit in a rotational direction of the image carrier and scraping a residual toner left on the image carrier surface. The transfer unit is located on a portion of the image carrier such that an imaginary normal extending outward from the image carrier surface is directed upward with respect to a horizontal direction and the transfer unit transfers the toner image to a lower surface of the recording member. The cleaning blade is brought into contact with a downward moving portion of the image carrier which has passed through the transfer unit, at a contact angle of not less than 90° relative to the downstream portion of the carrier in a "with" contact state, and the residual toner scraped by the cleaning blade is moved downard along an upper surface of the cleaning blade.

6 Claims, 13 Drawing Sheets

CLEANING BLADE ARRANGEMENT FOR IMAGE FORMING APPARATUS

BACKGROUND OF THE INVENTION

1. Field of the Invention

The present invention relates to an image forming apparatus such as a copying machine, a printer, or a facsimile apparatus and, more particularly, to an image forming apparatus having a cleaning blade for cleaning a toner left on an image carrier belt of the image forming apparatus.

2. Description of the Related Art

In a conventional image forming apparatus such as a copying machine, a printer, or a facsimile apparatus, an arrangement having a transfer unit on the upper surface of the image carrier belt to transfer and form a toner image on the lower surface of a recording sheet has the following advantages because a sheet convey unit is arranged in an upper portion of the image forming apparatus. Removal of a jammed sheet upon jamming and replenishment of sheets can be advantageously simplified. A sheet can be exhausted while an image surface faces down, so that confidentiality can be advantageously ensured.

In an image forming apparatus of this type, a toner left on the image carrier belt after image transfer is preferably cleaned in a range of downward movement of the image carrier belt or a range corresponding to the lowermost position due to the following reason. When cleaning is performed at a position away from the transfer unit, i.e., in the range of upward movement of the image carrier belt, the interior of the apparatus is contaminated or proper layout of other process means such as a latent image forming means and a developing unit which are adversely influenced by toner contamination becomes difficult by toner particles removed from the belt in the range of upward movement of the image carrier belt.

However, when the image carrier belt is cleaned with a blade in the range of downward movement of the belt, the following problems occur. That is, when the cleaning blade is brought into contact with the image carrier belt, i.e., when contact angle a1 of blade 101 and image carrier belt 102 is less than 90° (FIG. 1A) so that the blade direction is a counter direction of the feed direction of belt 102 (this contact state will be referred to as a "counter" contact state hereinafter), a reaction force of blade 101 acts to interfere movement of image carrier belt 102 in a direction of an arrow upon catching of toner 103 by blade 101. Image carrier belt 102 then slips on a drive roller to cause variations in speed of belt 102. Contact angle $\alpha 2$ between belt 102 and blade 101 must be larger than 90° (FIG. 1B) so that the direction of blade 101 is the same as the feed direction of belt 102 (this contact state will be referred to as a "with" contact state hereinafter). Reference symbol 104 in FIGS. 1A and 1B denotes a belt support member.

When blade 101 is brought into contact with image carrier belt 102 in the "with" contact state in the range of downward movement of belt 102, toner 103 is accumulated between the image carrier surface of image carrier belt 102 and the blade contact portion. The accumulated toner pushes the blade upward to cause incomplete cleaning.

SUMMARY OF THE INVENTION

The present invention has been made to solve the problems in conventional blade cleaning of the image forming apparatus, and has as its object to provide an image forming apparatus including a cleaning blade which can prevent incomplete cleaning.

In order to solve the above problems, there is provided, as shown in FIG. 2, an image forming apparatus for forming a toner image on an image carrier surface of image carrier belt 03 looped between driving roller 01 and at least one driven roller 02, for transferring the toner image on the lower surface of recording member 06 while transfer unit 05 is located at portion X on image carrier belt 03 whose imaginary normal 04 extending outward from the image carrier face is inclined upward from a horizontal direction, and for bringing cleaning blade 07 into contact with the image carrier surface of image carrier belt 03 in the downstream side of transfer unit 05, wherein cleaning blade 07 is brought into contact with portion Y of the image carrier surface from a position where the direction of normal 04 extending on the image carrier surface is changed from the upward direction to a downward direction with respect to the horizontal direction to a position where normal 04 is directed vertically downward, and cleaning blade 07 is located to satisfy $$5° \leqq \phi < \theta \leqq 90°$$

and preferably $10° \leqq \phi < \theta 80°$ assuming that imaginary horizontal plane 08 outwardly extending horizontally from a contact portion between the image carrier surface and the cleaning blade is used as a reference, that normal 04 of the image carrier surface which extends from the contact portion forms an angle $\theta$ below horizontal plane 08, and that contact line 09 of cleaning blade 07 forms an angle $\phi$ below horizontal plane 08. Of the portion Y of the image carrier surface, the positional range of the cleaning blade includes the range from a position where the direction of the normal to the image carrier surface is changed from the upward direction to the downward direction with respect to the horizontal direction to a position where the normal is inclined downward at an angle of less than 5° from the horizontal direction due to condition $5° \leqq \phi < \theta 90°$ described above.

As described above, transfer is performed on the upper side of rotating image carrier belt 03. At the same time, cleaning blade 07 is brought contact with the image carrier surface from the position where the direction of the normal extending on the image carrier surface is changed from upward direction to the downward direction with respect to the horizontal direction to the lowermost position upon driving of image carrier belt 03 while condition $5° \leqq \phi < \theta < 90°$ is satisfied. Therefore, cleaning blade 07 is inclined downward at an angle of 5° or more with respect to the horizontal plane and is brought in contact with the image carrier surface in the "with" contact state. The image carrier surface portion which is kept in contact with cleaning blade 07 is a lower surface from a position where the normal is inclined downward at an angle of 5° with respect to the horizontal plane to a position where the normal is inclined downward at an angle of 90° with respect to the horizontal plane.

The toner removed by cleaning blade 07 from the image carrier surface is not accumulated at the contact portion of blade 07 but drops downward along the upper surface of the gradually inclined blade, thereby preventing incomplete cleaning. Since cleaning blade 07 is in contact with the image carrier surface in the "with" contact state, variations in speed of the belt by a reaction force of the distal end of the blade can be almost eliminated. In addition, since the cleaning blade can be effectively arranged relatively near the position of transfer unit 05 located on the upper surface side of the belt, layout of other process means for the image carrier belt can be facilitated. Cleaning blade 07 need not be set within the winding angle range of driven roller 02 of image carrier belt 03, but may be arranged between rollers 01 and 02, as indicated by the dotted lines, to obtain the same effect as described above.

BRIEF DESCRIPTION OR THE DRAWINGS

Figure 23A:
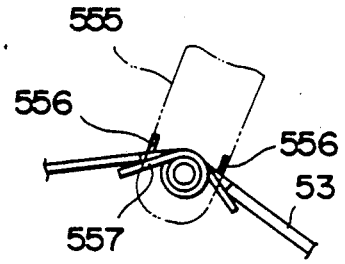
Figure 23B:
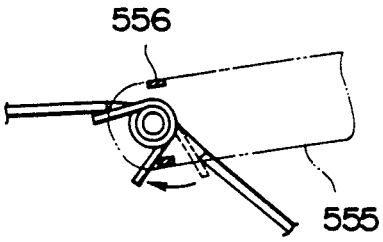
Figure 23C:
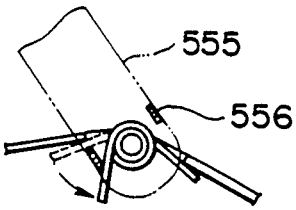
Figure 24A:
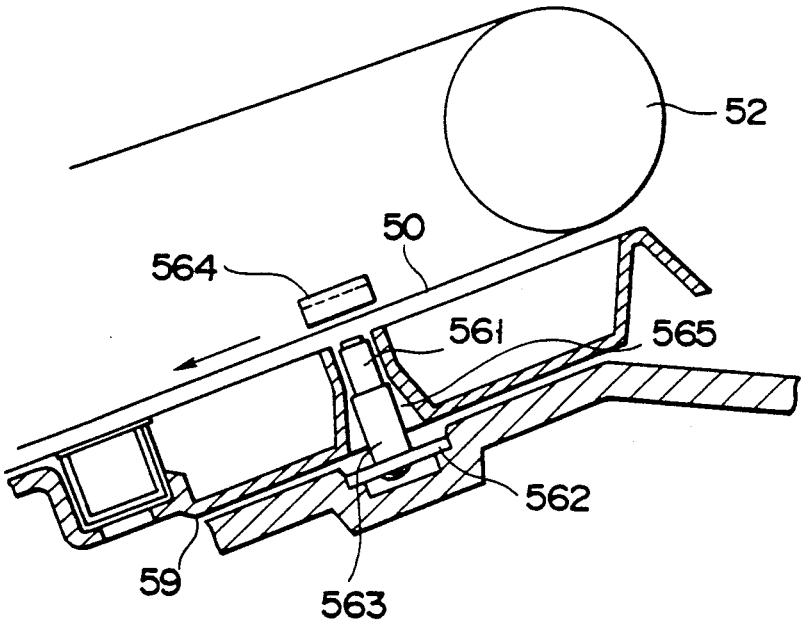
Figure 24B:
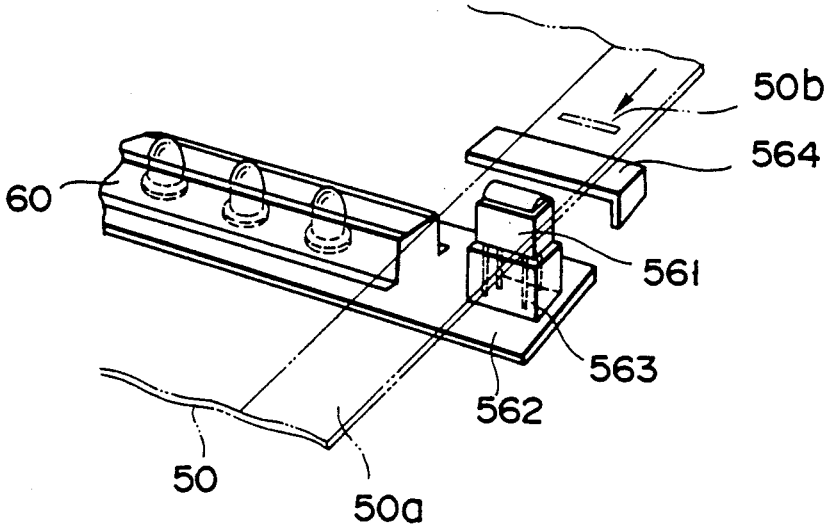

FIGS. 23A, 23B, and 23C are views showing operating states of the bent unit pullout handle; and FIGS. 24A and 24B are a sectional view and a perspective view, respectively, showing a belt position sensor portion.

DETAILED DESCRIPTION OF THE PREFERRED EMBODIMENTS

Figure 1A:
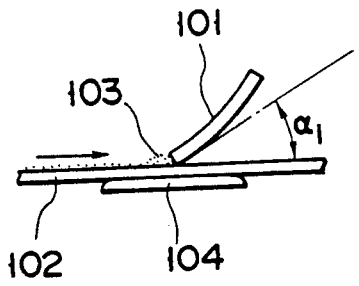
FIGS. 1A and 1B are views for explaining mounting states of the conventional blades.
Figure 1B:
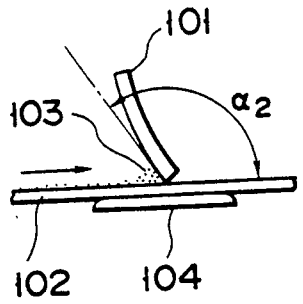
Figure 2:
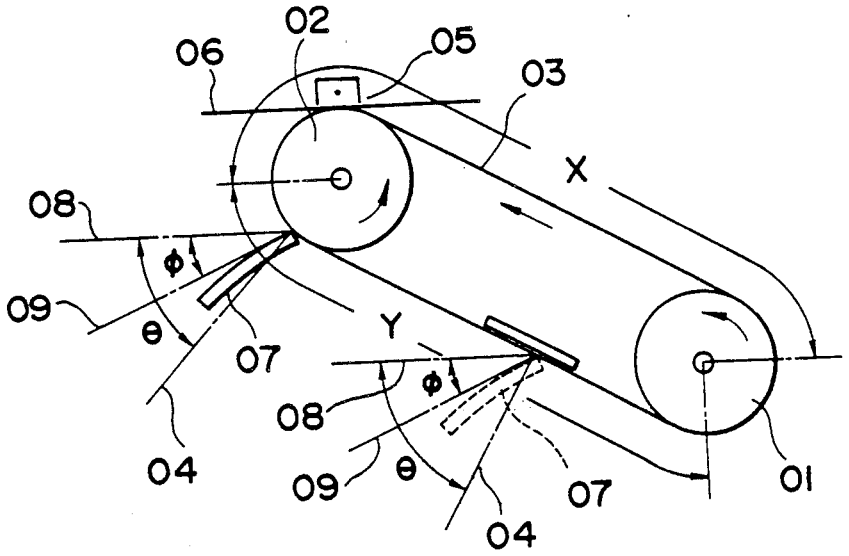
FIG. 2 is a view showing a principle of an image forming apparatus according to the present invention.
Figure 3:
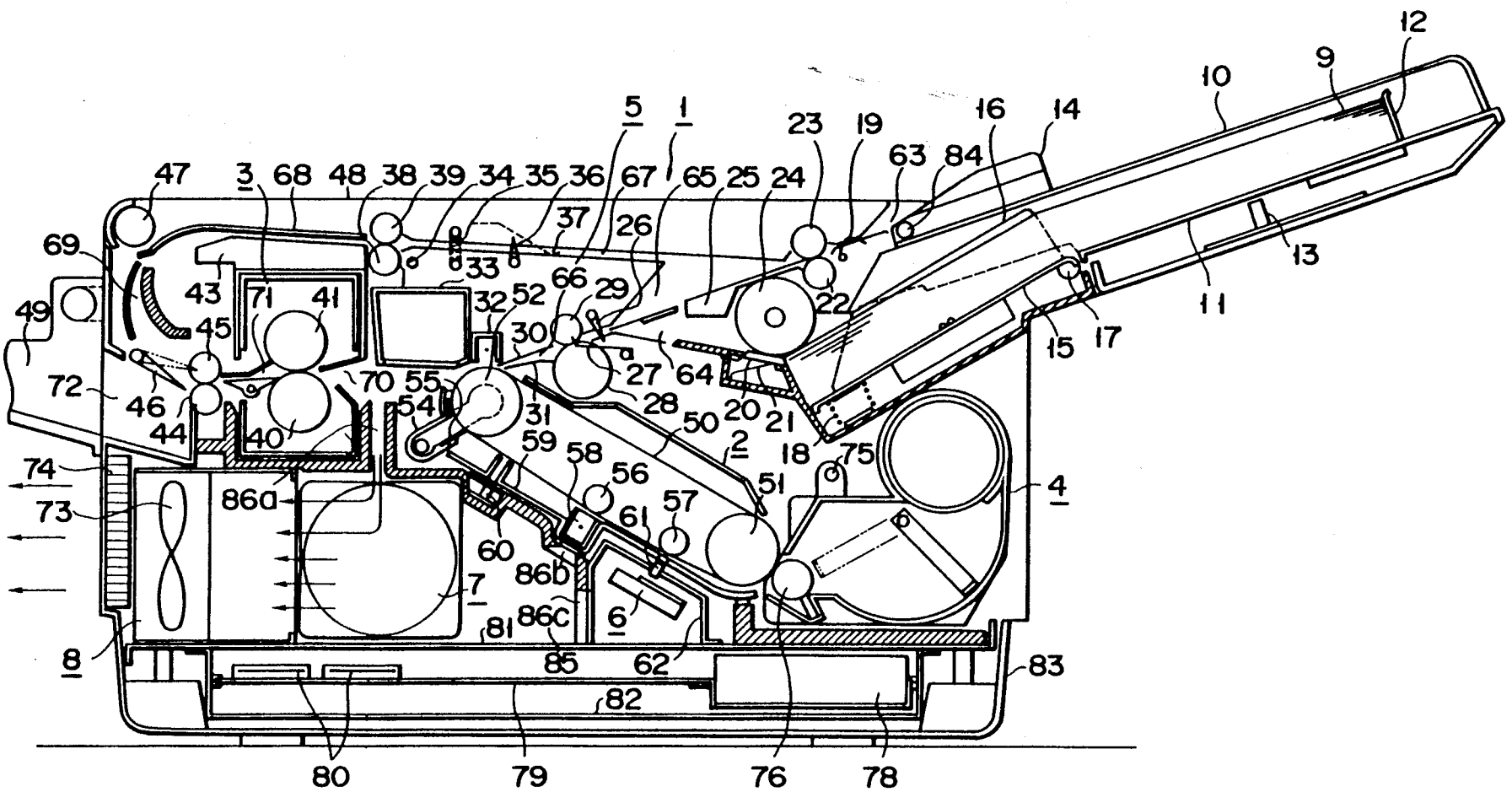
FIG. 3 is a view showing an overall arrangement of an image forming apparatus according to an embodiment of the present invention.

A preferred embodiment of the present invention will be described in detail below. FIG. 2 is a sectional view of an image forming apparatus according to an embodiment of the present invention when viewed from its front side. Hatched portions are portions for connecting front and rear frames. FIG. 3 shows a state of the image forming apparatus when upper surface cover 48 is open. Referring to FIG. 2 and 3, reference numeral 1 denotes a main body frame of the image forming apparatus; 2, a belt unit constituting an image carrier or the like; 3, a fixing roller unit; 4, a developing unit for developing a latent image; 5, a sheet convey unit; 6, a printing head for forming a latent image; 7, a motor; and 8, a power source unit.

Figure 4:
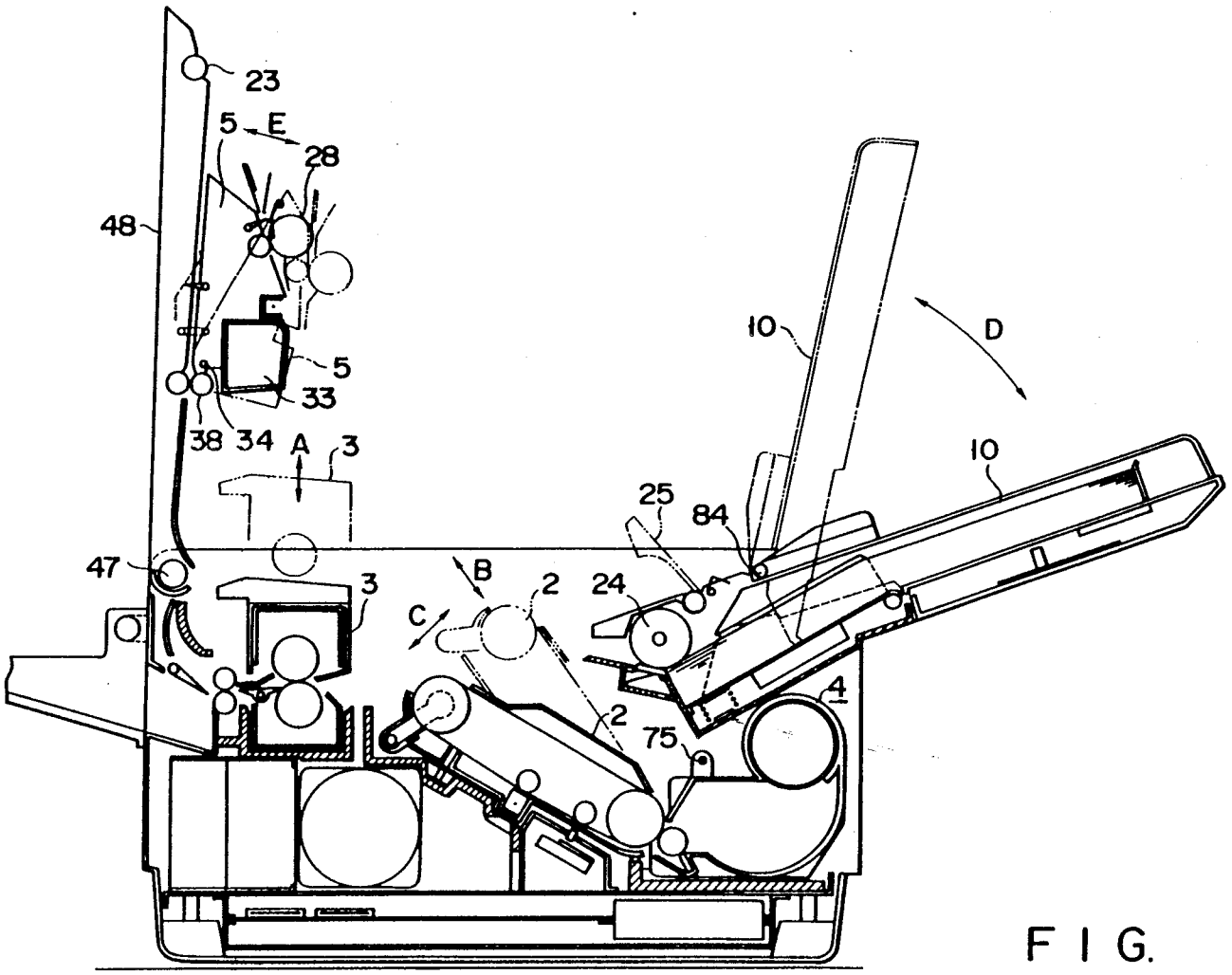
FIG. 4 is a view showing the image forming apparatus shown in FIG. 3 when an upper surface cover is opened.

One end of upper surface cover 48 is pivotally supported by shaft 47 in main body frame 1. Upper surface cover 48 can be pivoted about shaft 47 through 90° and can be opened, as shown in FIG. 4. Sheet convey unit 5 is loosely fitted on and supported by pivot point 34 and is held by spring 35 inside upper surface cover 48. Sheet convey unit 5 is pivoted together with upper surface cover 48 and can be opened. Pinch roller 23 opposite to manual feed roller 22 constituting part of manual sheet feed unit 14 serving as an intermediate tray having a sheet convey direction reversing function is pivotally arranged at the distal end portion of the inner surface of upper surface cover 48. Pinch roller 23 is pivoted together with upper surface cover 48 upward so as to be separated from roller 22.

Fixing roller unit 3 is detachable from a connecting portion of main unit frame 1 in a direction of arrow A in FIG. 4. Belt unit 2 is inserted in the main body unit in a direction of arrow B and rotated in a direction of arrow C, thereby mounting belt unit 2 in the main body frame. Belt unit 2 can be detached from the image forming apparatus by reverse procedures of the above operations. Developing unit 4 is swingably supported by pivot point 75 in the main body frame. Roller 76 of developing unit 4 is biased toward belt unit 2. Printing head 6 is fixed on frame 1 so as to oppose belt unit 2 below belt unit 2.

The main body frame consists of a single molded body and is fixed on base 81 made of an iron plate. Shield case 82 as a conductive box is welded to base 81. Base 81 is fixed to plastic bottom cover 83.

Sheet separation plate 20 biased toward sheet feed roller 24 by spring 21 is urged against roller 24 rotatably supported by the frame. The rear end of intermediate plate 15 is supported by shaft 17, and plate 15 is swingable about shaft 17. Intermediate plate 15 is biased toward paper feed roller 24 by spring 18 mounted at the lower surface of the distal end of intermediate plate 15. Tray 11 is fixed to the frame, and the rear portion of sheet 9 is placed on tray 11. The side edges of the leading end portion of sheet 9 are guided by side guides 16 arranged on both sides of intermediate plate 15. The trailing end portion of sheet 9 is positioned by trailing end regulating plate 12 which is slidable on tray 11. The leading end of sheet 9 is urged against paper feed roller 24 through intermediate plate 15 by a biasing force of spring 18. The position of trailing end regulating plate 12 is detected by sheet size sensor 13.

Moistureproof cover 10 surrounds sheet 9 together with tray 11 to open/close tray 11 about shaft 84 arranged in the frame in a direction of arrow D in FIG. 4. Manual sheet feed guide 14*a* for positioning a widthwise direction of sheet 9 is arranged at the distal end portion of moistureproof cover 10.

Manual feed roller 22 and pinch roller 23 are arranged above paper feed roller 24. Manual feed roller 22 is rotatably supported by the frame, while pinch roller 23 is supported on upper surface cover 48. In a state wherein upper surface cover 48 is kept closed, pinch roller 23 abuts against manual feed roller 22.

Manual feed sensor 19 is arranged in a manual feed insertion sheet path between manual feed roller 22 and manual feed guide 14*a*. The presence/absence of the sheet can be detected when sheet 9 urges sensor 19. Manual sheet feed path 65 formed by guide 2 and the like and path 64 of sheet 9 fed from tray 11 by paper feed roller 24 are vertically separated and merge near convey roller 28 and its pinch roller 29 which are located in the downstream side of the above paths. Registration sensor 26 is arranged at the merging point. The sheet is detected when the sheet urges registration sensor 26.

Gate plate 27, one end of which is pivotally supported by the main body frame, is arranged at a position nearer to the sheet feed side than a nip portion of convey roller 28. Gate plate 27 can extend to block the sheet path or can be removed therefrom. Sheet path 66 is formed by upper and lower sheet guides 30 and 31 in the downstream side of convey roller 28. Corona transfer unit 32 is arranged to oppose the uppermost portion of image carrier belt 50 of belt unit 2 at a position nearer to fixing unit 3 than to sheet path 66. Vacuum dust 33 having a slit in the lower surface is arranged on the side of fixing unit 3. Convey roller 28, pinch roller 29, registration sensor 26, gate plate 27, corona transfer unit 32, and vacuum duct 33 constitute sheet convey unit 5.

Belt unit 2 comprises a driving system, blade cleaning mechanism 54, and scorotron charger 58. This driving system comprises image carrier belt 50, driving roller 51, tension roller 52, corona shaft 56 serving as a backup roller, and head shaft 57. Image carrier belt 50 is looped around driving roller 51 and tension roller 52 and is driven by driving roller 51. Blade cleaning mechanism 54 includes cleaning blade 55 and an auger. Belt unit 2 is covered by SELFOC lens array 61 supported by frame 62 of printing head 6, sleeve 76 of developing unit 4, unit frame 53 having openings respectively corresponding to corona transfer unit 32 and discharge lamp 60, and cover 59 to constitute a single cartridge structure. When upper surface cover 48 at the upper portion of the main body frame is opened, belt unit 2 as a cartridge unit can be manually detached from frame 1 or replaced with another, as described above.

Fixing unit 3 comprises lower heat roller 40 for generating heat, and upper pressure roller 41 strongly urged against heat roller 40. Sheet path 70 is formed in fixing unit 3 on the side of belt unit 2 with respect to the nip of fixing unit 3, and sheet path 71 is formed on the side of exhaust roller 44. Exhaust roller 44 and pinch roller 45 are rotatably supported by the frame, and pinch roller 45 is in tight contact with exhaust roller 44. Gate 46 located in the downstream side of exhaust roller 44 is supported by the frame and can be pivoted between two positions. In the position indicated by the solid line in FIG. 3, gate 46 guides the sheet from rollers 44 and 45 to reverse sheet path 69. In the position indicated by the alternate long and two short dashed line in FIG. 3, gate 46 changes the feed direction of the sheet toward exhaust sheet path 72. Exhaust sheet path 72 extends outside the main body frame and is terminated at exhaust tray 49 for storing sheets thereon.

Reverse sheet path 69 is U-turned and connected to sheet path 68 formed between upper surface cover 48 and plastic sheet guide 43 fixed at the uppermost portion of fixing unit 3. Convey roller 38 rotatably supported by upper surface cover 48 and pinch roller 39 which is in tight contact with convey roller 38 are arranged on a line extended from sheet path 68. Sheet path 67 constituted by upper surface cover 48 and the frame of sheet convey unit 5 continues in a right downward direction of sheet path 68. Sensor 36 is arranged in sheet path 67. The presence/absence of the sheet is detected when the sheet urges sensor 36. Sheet path 67 merges into manual feed downstream path 65. Reference numeral 37 denotes a leaf spring for holding sheet path 67 at a predetermined height. The proximal end of leaf spring 37 is fixed to upper surface cover 48, and the distal end, i.e., the free end abuts against the frame of sheet convey unit 5.

As described above, belt unit 2 includes image carrier belt 50, its driving system, the blade cleaning unit, and the scorotron charger and is covered by unit frame 53 having openings corresponding to exposure, developing, transfer, discharge portions and cover 59, thus constituting the single cartridge structure. Belt unit 2 is inclined at an angle of 25° to 35° with respect to the horizontal plane and is fixed in the housing. Upper surface cover 48 is opened and inclined slightly upward, as shown in FIG. 4. In this state, belt unit 2 can be manually replaced. The detailed structure of belt unit 2 will be described below.

Figure 5:
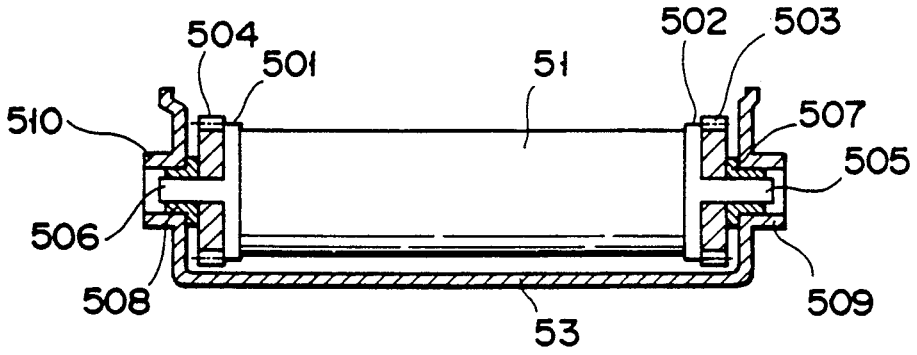
FIG. 5 is a view showing a partial section of a driving roller portion of a belt unit.
Figure 6:
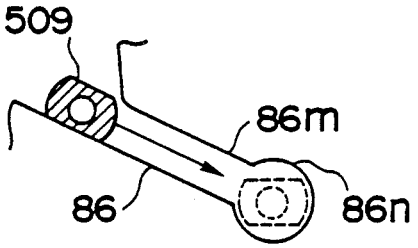
FIG. 6 is a view showing a mounting state of a driving roller in a main body frame.

Driving roller 51 has large-diameter portions or stepped portions 501 and 502 for preventing displacement of image carrier belt 50 at both ends, as shown in FIG. 5. Input and output gears 503 and 504 are disposed on shafts 505 and 506 outside large-diameter portions 501 and 502, and are coaxial with and integrally rotatable with driving roller 51. Shafts 505 and 50 extend through gears 503 and 504 and are rotatably supported by unit frame 53 through corresponding bearings 507 and 508. Outward projections 509 and 510 are formed in unit frame 53 so as to extend outward and be coaxial with driving roller 51. Projections 509 and 510 are cylindrical and support bearings 507 and 508 therein, respectively. As shown in FIG. 6, each projection 509 (or 510) has an oval shape constituting of a pair of flat surfaces and a pair of curved surfaces. The flat surface portions of oval projections 509 and 510 are slid along linear inclined guide grooves 86*m* (only the groove for projection 509 is illustrated in FIG. 6) formed in main body frame 86 in the direction indicated by an arrow (FIG. 6). When each oval projection 509 (or 510) reaches circular reference hole 86*n*, the oval projection is rotated such that its flat surface portions are horizontal, thereby aligning the axis of driving roller 51 in main body frame 86. At the same time, the position of circular reference hole 86*n* is defined as a positioning reference point of entire belt unit 2.

Each of large-diameter portions 501 and 502 formed at both ends of driving roller 51 has a height of 0.3 to 0.8 mm with respect to the outer surface of the central portion of roller 51. As shown in FIG. 3, large-diameter portions 501 and 502 abut against developing sleeve 76 of developing unit 4 outside the effective developing width at the openings of the unit frame, so that image carrier belt 50 having a thickness of about 0.1 mm forms a developing gap of 0.2 to 0.7 mm with developing sleeve 76. Since developing unit 4 is biased toward image carrier belt 50 upon pivotal movement about pivot point 75, precise gap precision between the belt and the developing sleeve can be assured. When a biasing voltage is applied to developing sleeve 76, the contact portion must consist of an electrically insulating material. If a member having the same function as those of large-diameter portions 501 and 50 is arranged independently of sleeve 51, electrical insulation between developing sleeve 76 and sleeve 51 can be ensured. When a gap regulating member is arranged in developing unit 4, the height of each of large-diameter portions 501 and 502 is set larger than 0.3 mm within the range which does not interfere with developing unit 4 and the like.

Figure 7:
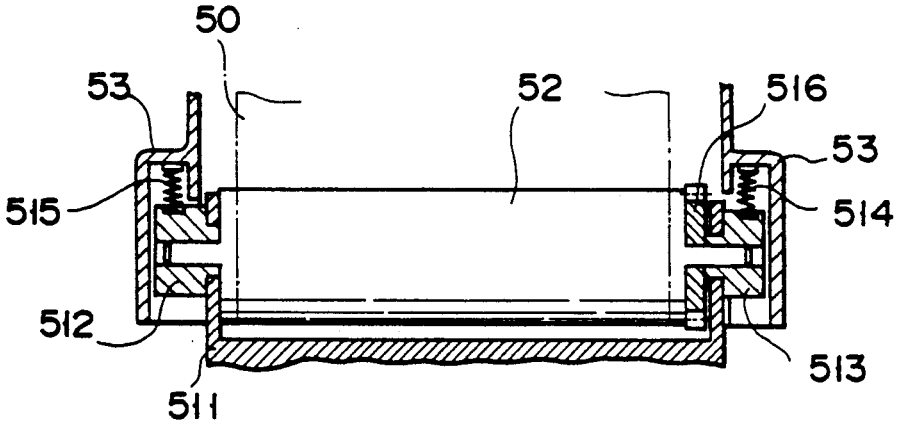
FIG. 7 is a view showing a partial section of a tension roller portion.
Figure 8:
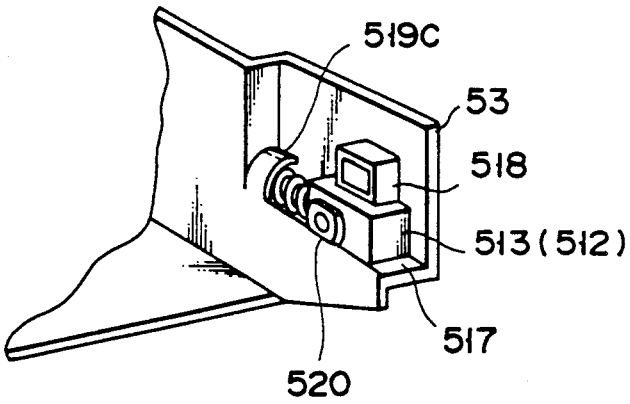
FIG. 8 is a perspective view showing a bearing portion of a tension roller.

As shown in FIG. 7, auger driving gear 516 is mounted at one end of tension roller 52 so as to be rotated together with roller 52. Tension roller 52 is supported by unit frame 53 through bearings 512 and 513. Bearings 512 and 513 rotatably support tension roller 52 at their inner-diameter portions. Two adjacent flat surfaces of the outer side surfaces of each bearing 512 (or 513) which are parallel to the axial direction of tension roller 52 and to the flat surface portion of image carrier bent 50 are respectively guided by guides 517 and 518 formed on unit frame 53, as shown in FIG. 8, and can be slid between guides 517 and 518. The position of bearing 513 (or 512) in the thrust direction is defined by one surface of unit frame 53 which is perpendicular to the axis of tension roller 52. Each of compression coil springs 514 and 515 is inserted between one surface of corresponding bearing 513 (or 512) on the side of driving roller 51 and the opposite surface of unit frame 53. A tension is applied to image carrier belt 50 through tension roller 52. Compression coil springs 514 and 515 are respectively supported by support portions **519*c* formed on unit frame 53. Hubs 520 for mounting cleaning unit 54 (to be described later) are mounted at parts of the inner-diameter portions of bearings 512 and 513**, respectively.

Figure 9:
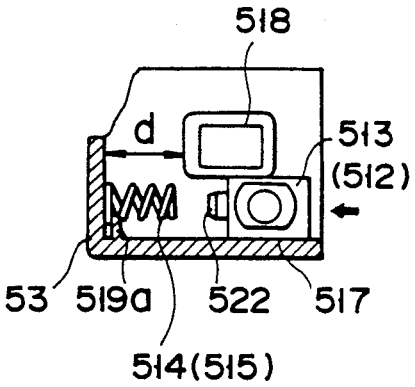
FIG. 9 is a view showing a tension applying mechanism for an image carrier belt.

A mechanism for applying a tension to image carrier belt 50 is very important to stably drive belt 50. A structure of this mechanism will be described below. FIG. 9 shows the simplest structure. A root portion of compression coil spring 514 (515) is inserted between unit frame 53 and corresponding support portion **519*a* formed at part of guide 517 of unit frame 53 to support compression coil spring 514 (515). Bearing 513 (512) fitted on tension roller 52 and cleaning unit 54 is inserted in a direction indicated by an arrow. Guide boss 522 compresses corresponding spring 514 (515) while being engaged with its inner-diameter portion, thereby obtaining a tension. Both ends of compression coil spring 514 (515) are fixed and stable elongation/contraction can be achieved. It should be noted that distance d between unit frame 53 and guide 518 is preferably longer than a free length of each compression coil spring 514 (515**).

Figure 10A:
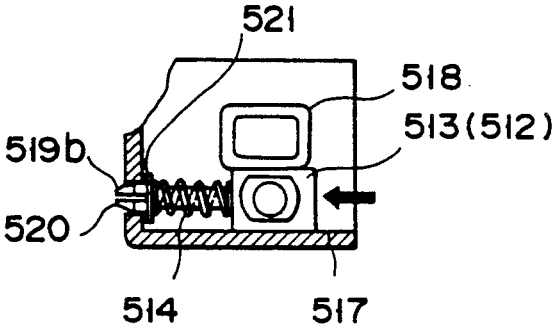
FIGS. 10A and 10B are views showing another tension applying mechanism for the image carrier belt.
Figure 10B:
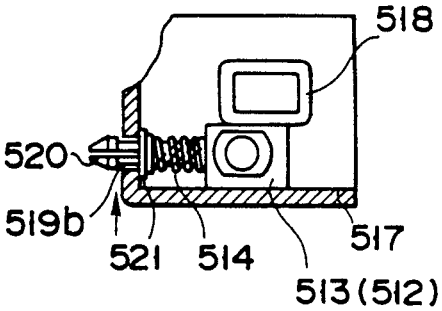

FIGS. 10A and 10B show a more preferable structure of the mechanism for applying a tension to image carrier belt 50. Pin 520 integrally extends on bearing 513 (512), and the distal cone of pin 520 is a large-diameter split portion. Therefore, the diameter of pin 520 can be reduced by its elasticity. Compression coil spring 514 (515) and washer 521 are fitted on pin 520 while the diameter of the distal end portion of pin 520 is kept reduced. Flexure of pin 520 is released in a state wherein compression coil spring 514 (515) is compressed to a predetermined degree. Washer 521 is engaged with the distal cone of pin 520 and serves as a stopper. In a state wherein spring 514 (515) is preloaded with a predetermined force, a bearing-spring assembly obtained by assembling each spring together with corresponding bearing 513 (512) is guided in a direction of an arrow in FIG. 10A, the distal end portion of the pin is inserted in support hole **519*b* of unit frame 53. When washer 521 abuts against a surface around support hole 519*b*, movement of the assembly is stopped in a state wherein the assembly extends through corresponding support hole 519*b*. As a result, compression spring 514 (515) is further compressed to generate a tension applied to image carrier belt 50**.

When the belt is generally looped around rollers, the tension springs must be displaced to positions where the springs are compressed with a load larger than a normal load. At the time of packing or during transportation, when the belt is to be loosened, the tension springs are urged in a direction to increase flexure according to the simplest method. For this purpose, the margin of strokes of the tension springs must be sufficient. In this case, the free length of each spring must be undesirably increased, and guides 517 and 518 shown in FIGS. 10A and 10B must be elongated. However, in a structure using a preloaded spring mechanism, the forces of the springs can be stably utilized, and the above-mentioned problem can be solved.

Figure 10C:
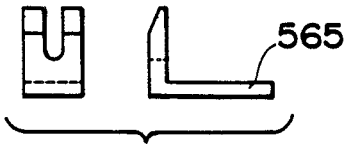
FIG. 10C is a view showing a tension release member.

When belt 50 may be held at a given position for a long period of time during, e.g., transportation, tension release member 565 having a U-groove at its distal end, as shown in FIG. 10C, can be inserted between the distal end large-diameter portion of pin 520 and unit frame 53 from a direction indicated by an arrow in FIG. 10B. Compression springs 514 and 515 are compressed to retract bearings 513 and 512 to positions where a tension does not act on image carrier belt 50.

Figure 11:
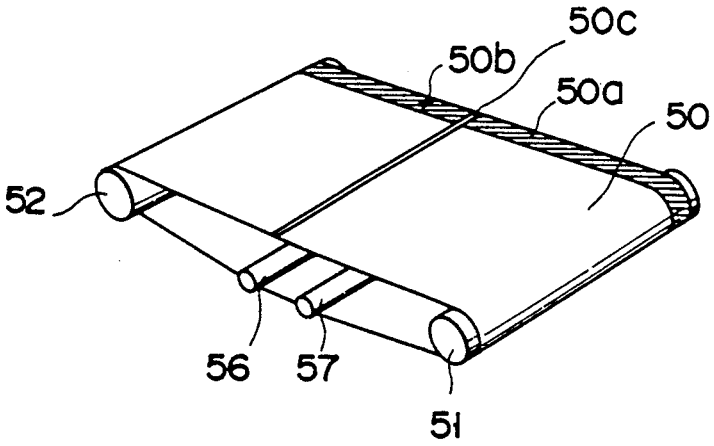
FIG. 11 is a perspective view showing an image carrier belt portion.
Figure 12:
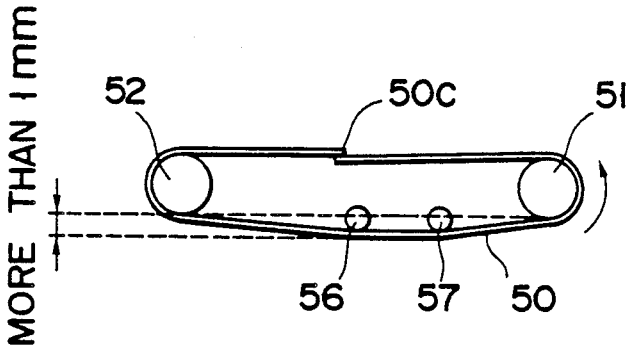
FIG. 12 is a view showing an expanding state of the image carrier belt.

Image carrier belt 50 is looped around four shafts including driving roller 51 and tension roller 52, as shown in FIGS. 11 and 12. Two remaining shafts excluding driving roller 51 and tension roller 52 are corona shaft 56 and head shaft 57. Corona shaft 56 and head shaft 57 are located to oppose charger 58 and SELFOC lens array 61, respectively, as shown in FIG. 3. Corona shaft 56 and head shaft 57 are arranged to prevent waving of belt 50. Shafts 56 and 57 are located at positions where image carrier belt 50 expands outward by 1 mm or more from the plane on which driving roller 51 and tension roller 52 are in contact with belt 50. Ground electrode **50*a* is formed at one side along the entire circumference of image carrier belt 50. Belt position detection slit 50*b* is formed in belt 50 at a position away from joint portion 50*c* by a predetermined distance. Image carrier belt 50 has a sufficient length for forming an image on the longest sheet used in the image forming apparatus. One print is produced by one revolution of belt 50. In this case, in order not to form an image portion at joint portion 50*c*, an image forming timing is determined so that slit 50*b* is detected by seam sensor 561 (FIGS. 24A and 24B). Joint portion 50*c*** is obtained by placing the upstream belt end portion on the downstream belt end portion and adhering them.

Figure 13A:
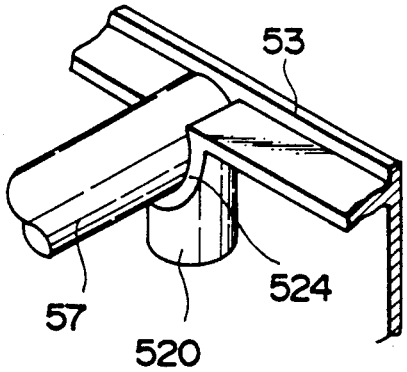
FIGS. 13A and 13B are views showing a head shaft portion.
Figure 13B:
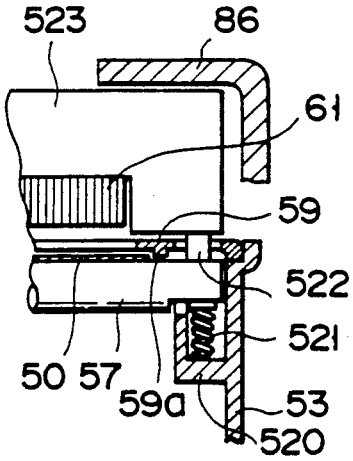

Both ends of corona shaft 56 are fixed on unit frame 53. However, since a distance between head shaft 57 and SELFOC lens array 61 or printing head unit 523 must be maintained with high precision, a support method shown in FIGS. 13A and 13B is employed. Spring 521 is dropped into holder 520 formed in part of unit frame 53, and head shaft 57 is fitted in U-groove 524 formed at one side of the upper portion of holder 520. Therefore, head shaft 57 is biased outward by spring 521. When belt unit 2 is not mounted in the main body or housing, head shaft 57 abuts against stopper 59*a* formed on cover 59 so that its downward movement (upward movement in FIGS. 13A an 13B) is regulated. Therefore, image carrier belt 50 is not brought into contact with cover 59. When belt unit 2 is mounted in the housing, positioning member 522 formed on head unit 523 including SELFOC lens array 61 mounted on main body frame 86 is inserted into a hole formed in cover 59 and urges head shaft 57. Therefore, the distance between head unit 523 and image carrier belt 50 is kept constant with high precision by the length of member 522.

Figure 14A:
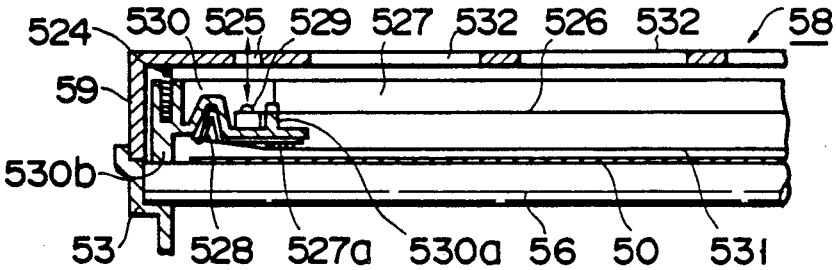
FIGS. 14A and 14B are a sectional view and a bottom view, respectively, of a charger.
Figure 14B:
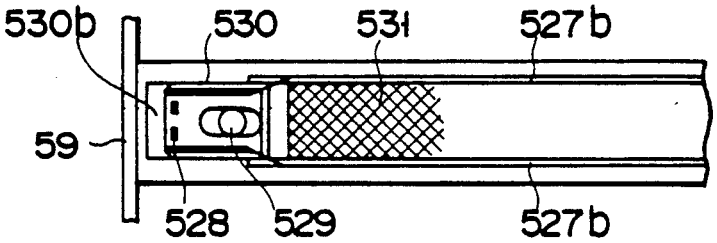

FIGS. 14A and 14B show the main part of charger 58 built into cover 59 of belt unit 2. Plastic holders 530 are formed at both ends of shield case 527 (only one holder is illustrated in FIGS. 14A and 14B). Leaf spring 528 is fixed on connecting portion 527*a* for connecting right and left side plates 527*b* of shield case 527 so as to maintain conduction. An end portion of scorotron mesh 531 is engaged with a distal pawl portion of leaf spring 528, so that mesh 531 is kept taut by elasticity of leaf spring 528. The distal pawl portion of leaf spring 528 is arranged so as not to extend from connecting portion 527*a* of shield case 527 toward head 50. Therefore, the height of scorotron mesh 531 and a distance between mesh 531 and the belt are regulated by connecting portion 527*a*. Corona wire 526 is hooked on regulating plate 530*a* of holder 530 and is vertically positioned. Corona wire 526 is then fixed to holder 530 by pin 529 with a predetermined tension.

Spring 524 is held in holder 530 near a side spaced apart from shield case 527, and projection 530*b* is formed to almost oppose spring 524. In a state wherein charger 58 is built into belt unit 2, spring 524 is compressed between projection 530*b* and the wall surface of cover 59 which freely reciprocates charger 58, so that cover 59 and charger 58 are biased to separate from each other. The distal end of projection 530*b* abuts by its biasing force against the end portion of corona shaft 56 supported by unit frame 53, and therefore the distance between charger 58 and image carrier belt 50 is kept constant. That is, the distance between image carrier belt 50 and corona wire 526 is determined by the dimensional precision of holder 530, and the distance between mesh 531 and belt 50 is determined by the dimensional precision of holder 530, and the thicknesses of connecting portion 527*a* of shield case 527 and leaf spring 528.

Ozone exhaust hole 532 is formed in the rear surface of the charger holding portion of cover 59. Bias voltage contacts for shield case 527 and mesh 53 are inserted from part of hole 532. Wire power supply port 525 is formed in the upper portion of pin 529 on the power supply end portion. Power supply members for wire 526 are guided through power supply port 525 in directions of a double-headed arrow in FIG. 14A. These power supply members (not shown) are arranged on the main body and can be reciprocated upon detachment of belt unit 2 from the main body. When belt unit 2 is mounted in the main body, these power supply members are powered. Pin 529 fixed on corona wire 526 is located at a holder 530 portion which holds spring 524. An opening is formed in a cover 59 portion which abuts against spring 524. The power supply members for the main body may be inserted from this opening, and corona wire 526 may be powered through spring 524. With this arrangement, spring 524 for biasing charger 58 toward corona shaft 56 also serves as a power supply contact spring.

Figure 15:
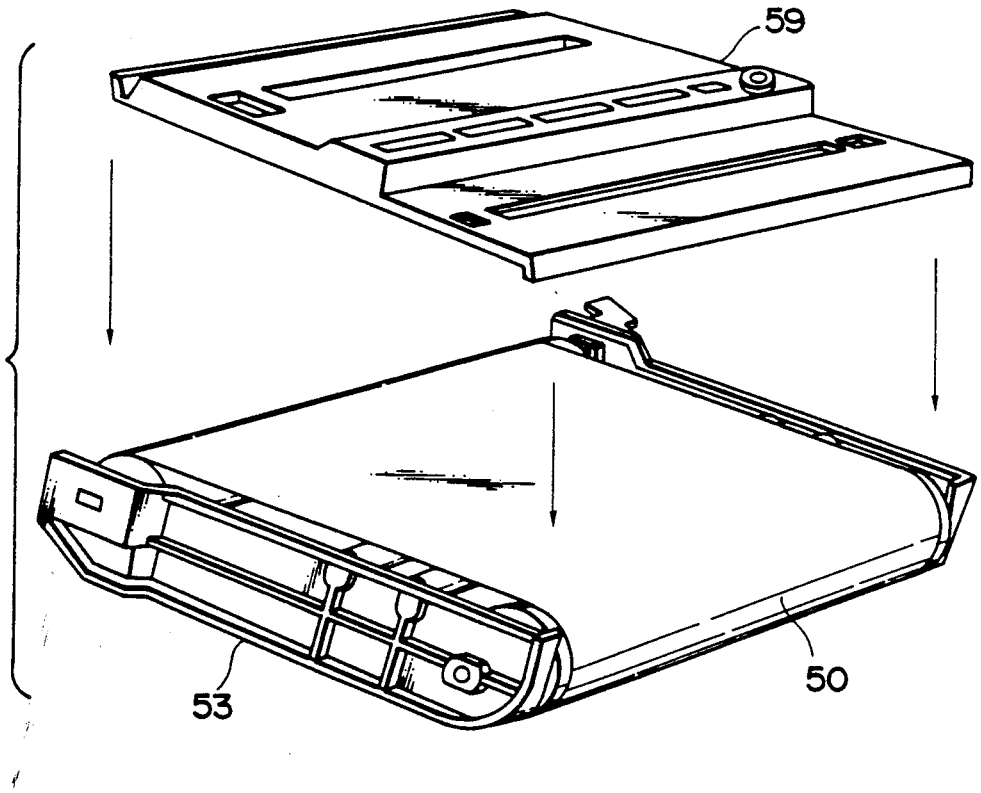
FIG. 15 is a view showing a unit frame and a cover portion.

FIG. 15 shows unit frame 53 around which belt 50 is looped, and cover 59 moved in a direction of arrows and mounted on unit frame 53.

Figure 16:
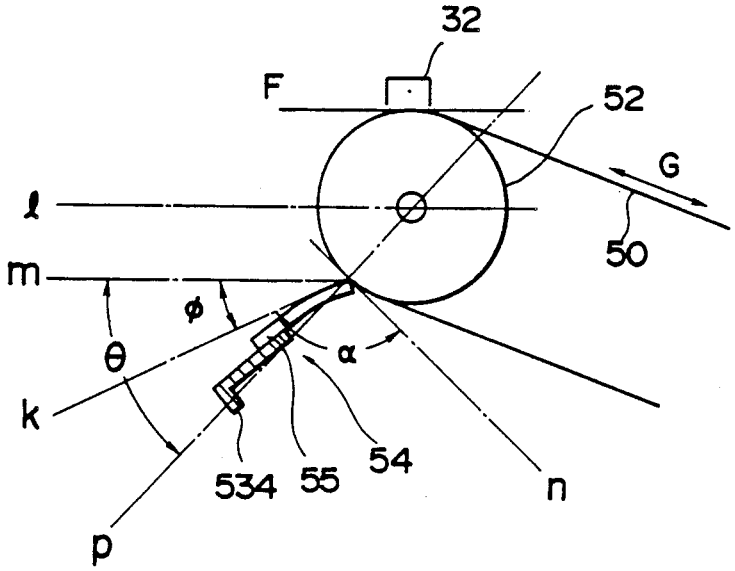
FIG. 16 is a view for explaining a method of bringing a cleaning blade into contact with the image carrier belt.
Figure 17:
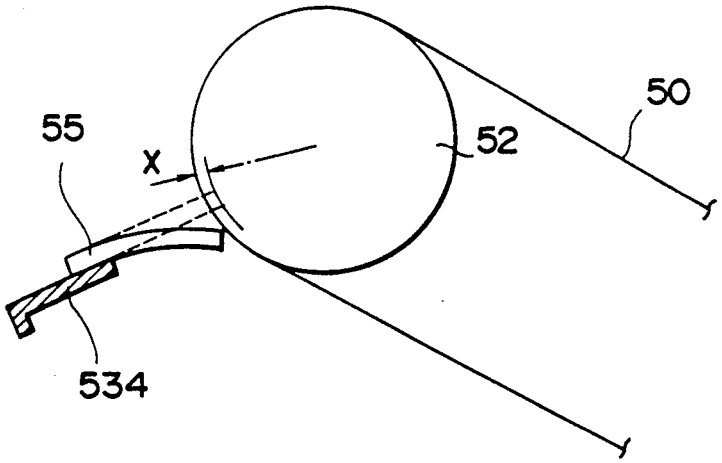
FIG. 17 is a view showing a flexing amount of the cleaning blade.

FIGS. 16 to 18B are views for explaining an operation for bringing cleaning blade 55 in blade cleaning unit 54 as part of the belt unit into contact with image carrier belt 50. Referring to FIG. 16, arrow F represents a sheet feed direction, and arrow G represents a driving direction of image carrier belt 50. The transfer unit is located above tension roller 52 on which image carrier belt 50 is looped. Corona transfer unit 32 constituting the transfer unit is located on the side opposite to tension roller 52 with respect to the sheet path. Cleaning blade 55 is brought into contact with image carrier belt 50 within the winding angle range of image carrier belt 50 on tension roller 52 at the downstream side of the transfer unit along the driving direction of image carrier belt 50 in this embodiment.

Referring to FIG. 16, reference symbol l denotes a horizontal line passing through the center of tension roller 52; m, a horizontal line passing through the blade contact position; k, a straight line representing the blade contact direction; n, a tangential line at the blade contact position; and p, a normal at the blade contact position. Optimal angle $\phi$ formed by m and k in this embodiment is 35°, and optimal angle $\theta$ formed by m and p is 55°, both of which must satisfy condition $5° \leqq \phi < \theta \leqq 90°$ according to the present invention. An angle formed by k and m, so-called blade contact angle (contact angle) $\alpha$ is 110°, so that the blade can be brought into contact with the belt in a "with" contact state. The blade contact point is located below straight line l. Other setting conditions cannot allow a perfect scraping effect of the toner by blade 55 and smooth conveyance of the toner by its own weight, and cause variations in speed of image carrier belt 50 and incomplete cleaning.

Cleaning blade 55 is fixed to holder 534, and holder 534 is in turn fixed to cleaning frame 538. A pressure of contact of blade 55 and image carrier belt 50 is determined by only a flexing amount of blade 55. In order to obtain a uniform contact pressure along the entire width of the belt, the flexing amount must be controlled. In this embodiment, the flexing amount is represented by a distance x (FIG. 17) between the center of tension roller 52 and the free edge of blade 55 with respect to image carrier belt 50. In this embodiment, when blade 55 consists of rubber having a hardness value of 60 to 80°, $x = 0.3$ to 1.0 mm and more preferably $x = 0.4$ to 0.7 mm, thereby obtaining a good result.

Figure 18A:
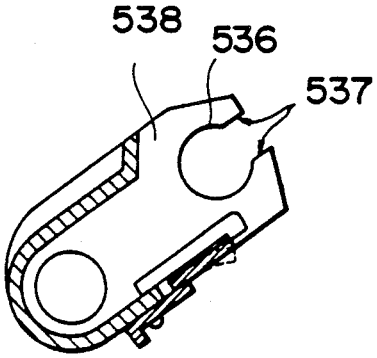
FIGS. 18A and 18B are views showing a cleaning blade positioning mechanism.
Figure 18B:
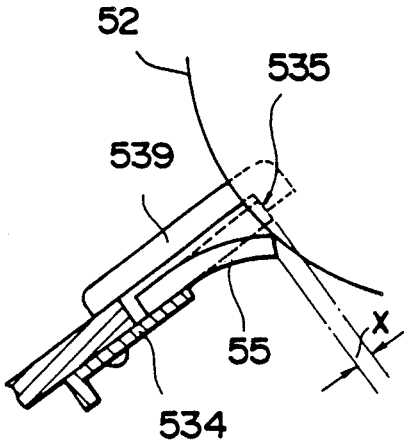

In order to accurately set the distance within the above-mentioned range, a blade positioning means shown in FIGS. 18A and 18B is employed. Projections 539 are formed on both side plates of cleaning frame 538, and abutment portion 535 is formed by part of projection 539 in a predetermined assembly state so as to extend from the surface of image carrier belt 50 by distance x corresponding to the blade flexing amount. At the time of assembly of single blade cleaning unit 54, both end portions in the widthwise direction of blade 55 are brought into contact with abutment portion 535, thereby fixing holder 534. Blade cleaning unit 54 is brought into contact with tension roller 52 which supports image carrier belt 50 by using each positioning hole 536 as a guide. In this state, blade 55 is flexed from the free position indicated by a dotted line by a predetermined flexing amount, and blade 55 is flexed to an actual operation position indicated by the solid line. Blade 55 is separated from abutment portion 53 and performs cleaning in a free state. In this embodiment, the height of abutment portion 535 is set to be about ½ the thickness of blade 55 so as to assure separation of blade 55 from abutment portion 535.

Figure 19A:
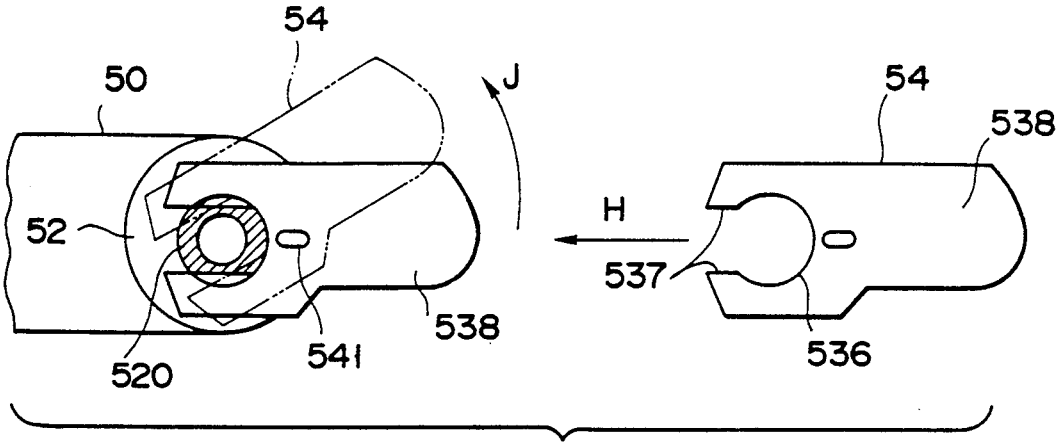
FIGS. 19A and 19B are views showing mounting states of a cleaning unit.
Figure 19B:
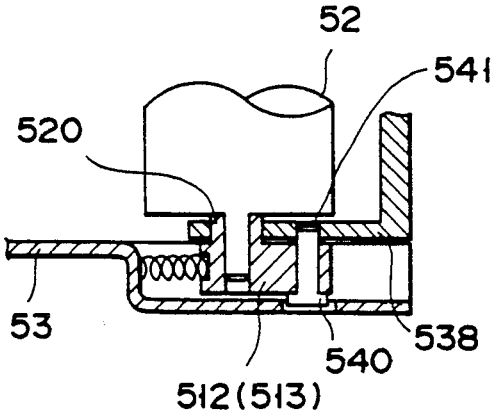

FIGS. 19A and 19B show a method of mounting blade cleaning unit 54 on belt unit 2. Blade cleaning unit 54 is disposed on the side of tension roller 52 because a tension side of image carrier belt 50 must oppose charger 58 and printing head 6 due to the overall construction shown in FIG. 3 and driving roller 51 is disposed on the side of developing unit 4. The axis of tension roller 52 is slightly displaced in a sliding direction of bearings 512 and 513 in accordance with a belt tension and a variation in belt length. Therefore, if blade cleaning unit 54 is positioned or fixed on unit frame 53 of belt unit 2 or main body frame 86, a predetermined flexing amount of blade 55 may not be assured. In this embodiment, blade cleaning unit 54 is mounted using tension roller 52 as a guide and can follow movement of tension roller 52 to maintain a predetermined tension. Therefore, an optimal blade pressure can always be maintained.

As described with reference to FIGS. 8 to 10C, both shaft end portions of tension roller 52 are supported by bearings 512 and 513, respectively. Hubs 520 are formed in bearings 512 and 513 to mount blade cleaning unit 54. Since each hub 520 has an oval shape, guide portion 537 formed by partially notching positioning hole 536 in cleaning frame 538 is fitted on the flat surface portions of hub 520 in a direction of arrow H in FIG. 19A. Blade cleaning unit 54 is then pivoted at a predetermined angle, indicated by the alternate long and short dashed line of arrow J. As shown in FIG. 19B, rotation stopper member 540 supported by each bearing 512 (or 513) is engaged with rotation stopper hole 541, so that rotational movement of blade cleaning unit 54 is prevented by rotation stopper member 540. In this manner, blade cleaning unit 54 is fixed by bearings 512 and 513 and is held by belt unit 2 through bearings 512 and 513.

Figure 21:
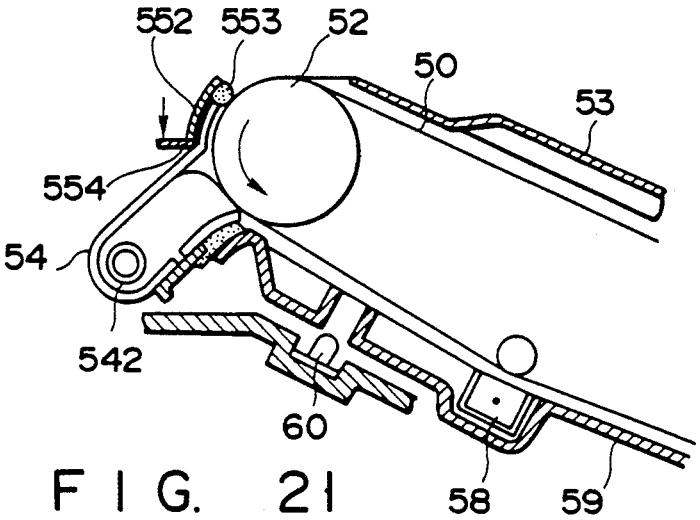
FIG. 21 is a view showing a closing portion of an opening of the cleaning unit.

Blade cleaning unit 54 in this embodiment incorporates toner feed auger mechanism 542, as shown in FIG. 21. An exhausted toner scraped by blade 55 is fed toward the front side of the main body and is exhausted from an end portion of belt unit 2. The exhausted toner is fed to an exhaust toner feed unit (not shown) in the main body. Since belt unit 2 can be manually detached, an exhausted toner feed path connecting portion between belt unit 2 and the main body requires a shutter mechanism which prevents toner leakage.

Figure 20A:
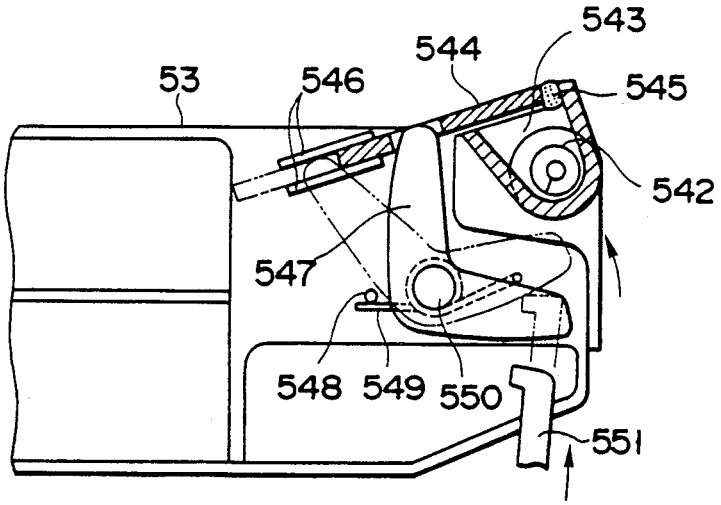
FIGS. 20A and 20B are a side view and a perspective view, respectively, showing a structure of an exhaust toner convey path connecting portion.
Figure 20B:
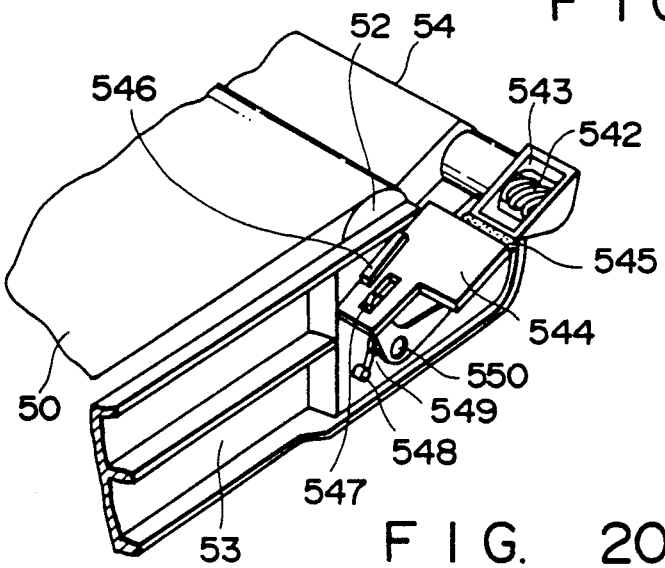

FIGS. 20A and 20B show the main part of the shutter mechanism. The upper and lower positions are reversed from the normal positions of use for illustrative convenience. Toner exhaust port 543 formed at the end portion of blade cleaning unit 54 is closed by shutter plate 544 when belt unit 2 is located outside the main body or when upper surface cover 48 for attaching or detaching the belt unit 2 is open even if belt unit is mounted inside the main body. A joint between shutter plate 544 and toner exhaust port 543 is sealed by sealing member 545 mounted on one end of shutter plate 544, thereby preventing toner leakage. With respect to the frame, shutter plate 544 is slidably supported along guide 546 mounted on unit frame 53. One end of L-shaped actuation lever 547 is engaged with an elongated hole formed at the central portion of shutter plate 544. Actuation lever 547 is pivotally supported by pivot shaft 550 mounted in unit frame 53. One end of actuation lever 547 is locked by stopper 548 mounted on the frame. The central portion of lever 547 is always biased by torsion coil spring 549 in a direction for closing the shutter (i.e., clockwise direction in FIG. 20A).

Cover 48 is pivoted to open the upper portion of the main body, belt unit 2 is mounted in the main body, and upper surface cover 48 is then pivoted to close the opening. In this case, projection 551 formed on upper surface cover 48 abuts against the other end of lever 547, the other end of lever 547 is pushed against the biasing force of spring 549, and lever 547 is pivoted in a direction of an arrow in FIG. 20A (counterclockwise direction). As a result, one end of lever 547 pulls shutter plate 544, and exhaust port 543 is opened. At this time, a force required for keeping shutter plate 544 in an open state is concentrated on unit frame 53. At least during opening of the shutter, no force acts on blade cleaning unit 54, and the belt tension is not adversely affected.

When belt unit 2 is removed from the main body, exhaust toner port 543 must be closed, and an opening for receiving a noncleaned surface of image carrier belt 50 into blade cleaning unit 54 must also be closed. A mechanism required for the above operation is illustrated in FIG. 21. Cover 552 for closing the opening is pivotally supported by support shaft 554 on cleaning frame 538. The free end of cover 552 is covered with sealing member 553 along its entire width. Cover 552 is always biased in a direction to urge sealing member 553 against image carrier belt 50. When main body upper surface cover 48 is gradually closed in the same manner as in the shutter unit, part of cover 48 applies a force in a direction of an arrow on the free end of cover 552, so that sealing member 553 is separated from image carrier belt 50.

Figure 22A:
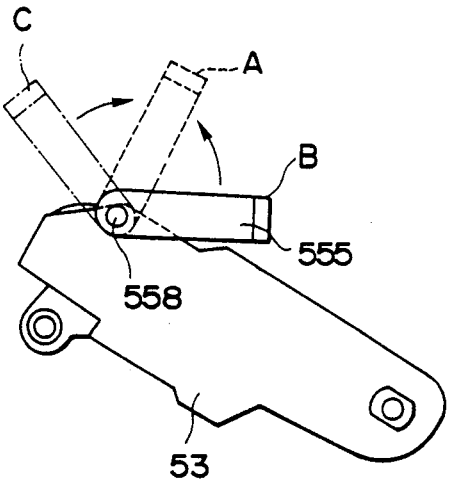
FIGS. 22A and 22B are a view for explaining an operation of a belt unit pullout handle and an exploded perspective view of its mounting structure, respectively.
Figure 22B:
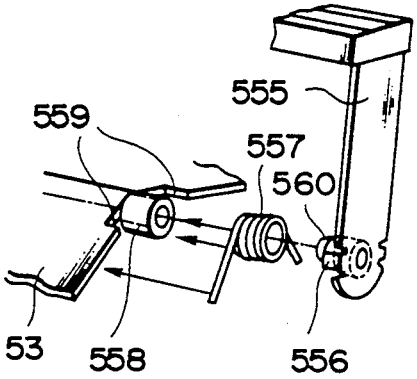

FIGS. 22A and 22B are a view for explaining a generation operation of unit pullout handle 555 and an exploded perspective view showing its mounting structure, respectively. Unit handle 555 can restore a free position (A) by itself even if handle 555 is inclined in a mounting position (B) or a pullout position (C), as shown in FIG. 22A. An automatic return mechanism will be described with reference to FIG. 22B. Torsion coil spring 557 is wound at its central portion around boss 558. Boss 558 is located near the transfer unit of unit frame 53. Both arms of torsion coil spring 557 are locked near rib ends 559 of unit frame 53 extending near boss 558 in a state of a predetermined preload. Pin 560 extending from handle 555 is fitted in an inner-diameter portion of boss 558 to pivotally support handle 555. In this embodiment, identical mechanisms are employed at both ends of handle 555, respectively. However, if sufficient rigidity is obtained, one of the mechanisms may be replaced with a simple pivot mechanism. In order to attach handle 555, pins 560 at both ends of handle 555 are expanded and are engaged with bosses 558, respectively.

A pair of pawls 556 are formed at symmetrical positions of handle 555 with respect to its longitudinal axis. As shown in FIG. 23A, at the free position A, pawls 556 abut against outer side portions of torsion coil spring 557 and do not apply a force to torsion coil spring 557. In the state of the mounting or pullout position (B) or (C) in FIG. 23B or 23C, one of pawls 556 is inserted inside unit frame 53 and abuts against torsion coil spring 557 which is then flexed. A restoration or return force is generated to return handle 555 to the free position (A). Therefore, handle 555 is always kept at the free position (A) in a free state. When upper surface cover 48 is closed, handle 555 is pushed by part of upper surface cover 48 from the free position (A) to the mounting position (B). A force is generated to push belt unit 2 toward the main body with respect to the handle end as a fulcrum.

In order not to form an image portion on joint portion 50*c* of image carrier belt 50, the position of belt 50 must be detected. In this embodiment, as shown in FIGS. 24A and 24B, reflecting photosensor 561 as a seam sensor is arranged in the main body. Photosensor 561 detects slit 50*b* at one side of image carrier belt 50 through opening 565 of cover 59 of unit 2 upon mounting of belt unit 2. Since a black conductive material is applied to the entire circumferential portion with slit 50*b* of image carrier belt 50, white reflecting plate 564 is arranged on the rear surface of the belt at the detection position to ensure detection of slit 50*b*. A vertical position of reflecting sensor 561 is determined by spacer 563 and is directly mounted on discharge lamp board 562.

A recording operation of the image forming apparatus having the above arrangement will be described below. Other rollers except for sheet feed roller 24 and manual feed roller 22, that is, convey roller 28, exhaust roller 44, convey roller 38, and heat roller 40 of fixing unit 3 are rotated at a constant speed of, e.g., 90 mm/sec upon starting of a recording operation. When the recording operation is started, sheet feed roller 24 is rotated in response to a driving signal based on a detection signal from seam sensor 561 for detecting slit 50*b* of image carrier belt 50. Upon rotation of paper feed roller 24, sheets 9 are fed from tray 11 to the transfer unit one by one. When a leading end of each sheet passes through sheet path 64 and is detected by registration sensor 26, rotation of sheet feed roller 24 is stopped. The sheet is stopped such that its leading end abuts against gate plate 27.

Upon starting of the recording operation, image carrier belt 50 is rotated by driving roller 51 in belt unit 2. Image carrier belt 50 is cleaned by cleaning blade 55. The image carrier surface of image carrier belt 50 which is discharged by discharge lamp 60 is uniformly charged by charger 58. A predetermined latent image is formed on the image carrier surface by printing head 6 in synchronism with a detection signal from seam sensor 561 such that an image portion is not formed on joint portion 50*c* of image carrier belt 50 The toner image is visualized by developing unit 4 into a toner image, and the toner image on image carrier belt 50 is conveyed toward the transfer unit.

When gate plate 27 is retracted in synchronism with conveyance of the toner image so that sheet 9 synchronously reaches the transfer unit when the toner image reaches the transfer unit, the leading end of the sheet is clamped between convey roller 28 and pinch roller 29, and the sheet is conveyed toward the transfer unit. The toner image is transferred to the lower surface of sheet 9 by the transfer unit, and the sheet having the toner image on its lower surface is fixed by fixing unit 3. The sheet having the fixed image is conveyed by exhaust roller 44 and is directed upward along gate 46 switched to the position of the solid line. The sheet passes through reverse sheet path 69 and two-side recording sheet path 68 and is conveyed toward convey roller 38. The sheet is guided by convey roller 38 along sheet path 67 and conveyed toward manual feed roller 22.

The toner which is not transferred to sheet 9 by the transfer unit and is left on image carrier belt 50 is removed by cleaning blade 55 in cleaning unit 54. Electrostatic component on the image carrier surface is removed by discharge lamp 60, so that image carrier belt 50 is prepared for the next cycle of formation of a latent image by printing head 6.

In this embodiment, after an image is transferred to one surface of a sheet and then fixed thereon, second sheet 9 is fed from tray 11 to the transfer unit on the basis of a detection signal from seam sensor 561. Similarly, a toner image formed on image carrier belt 50 is transferred to the second sheet and fixed thereon.

When first sheet 9 reaches near manual feed roller 22, manual feed roller 22 is rotated at a predetermined high speed of, e.g., 360 mm/sec from a predetermined timing based on the detection signal from seam sensor 561 in a direction opposite to that of manual sheet feeding. When the leading end of the first sheet reaches manual feed roller 22, it is rapidly conveyed into manual feed insertion path 63. When the trailing end of the sheet is detected by sensor 36 located in sheet path 67 and a predetermined period of time has elapsed, rotation of manual feed roller 22 is stopped. At this time, the sheet conveyed into the manual feed unit is observed to check an image formation state of the sheet.

Forward rotation of manual feed roller 22 is started at a convey speed of, e.g., 180 mm/sec from a predetermined timing based on the detection signal from seam sensor 561. First sheet 9 which is conveyed in manual feed insertion path 63 and waiting while its trailing end is clamped between manual feed roller 22 and pinch roller 23 is conveyed toward convey roller 28 through sheet path 65 in an opposite convey direction. In the same operations as described above, the toner image is transferred to the lower surface of the sheet and fixed thereon. The sheet is then guided along exhaust sheet path 72 through gate 46 switched to the position by the alternate long and two short dashed line and is exhausted onto exhaust tray 49 outside the image forming apparatus.

When the manual feed unit is used as a means for reversing the convey direction of the sheet, the speed of manual feed roller 22 is higher than those of other convey rollers due to the following reason. The convey direction of the first sheet is immediately reversed to record the toner image on the lower surface so as not to interfere conveyance of the second sheet. When manual feed roller 22 is used for manual sheet feeding, the speed of manual feed roller 22 can be equal to those of other convey rollers. It should be noted that convey roller 38 is driven through a one-way clutch to prevent any convey trouble when the sheet is conveyed by manual feed roller 22 having a high convey speed.

Elimination of paper jamming occurring during recording will be described below. Upper surface cover 48 which supports sheet convey unit 5 located above belt unit 2 with shaft 34 and suspension spring 35 is opened in the upper direction about pivot shaft 47, as shown in FIG. 4, so that sheet paths 63, 64, 65, 68, and 70 are open. Paper jamming occurring along these paths can be easily eliminated. Sheet convey unit 5 is pivoted about shaft 34 against spring 35 in a direction indicated by arrow E to open sheet path 67 serving as part of the two-side recording sheet path. Therefore, paper jamming occurring along sheet path 67 can also be easily eliminated.

According to the present invention as has been described in detail with reference to the preferred embodiment, the cleaning blade is inclined downward at an angle of 5° or more with respect to the horizontal plane and is brought into contact with the image carrier surface in a "with" contact state. The toner removed from the image carrier surface by the cleaning blade is not accumulated in the blade contact portion and can be dropped along the upper surface of the inclined blade. Incomplete cleaning caused when the accumulated toner pushes the blade upward can be effectively prevented.

Since the blade is in contact with the image carrier surface in a "with" contact state, variation in speed of the belt which is caused by a reaction force of the distal end of the blade rarely occurs. In addition, since the cleaning blade can be located at a position relatively close to the transfer unit located on the upper surface of the belt, layout of other process means with respect to the image carrier belt can be facilitated.

What is claimed is:

1. In an image forming apparatus comprising:

a main body;

an image carrier rotatably disposed in said main body and having an image carrier surface;

means for forming a toner image on said image carrier surface;

transfer means located near said image carrier and having a transfer unit for transferring the toner image formed on said image carrier surface to a recording member; and cleaning means located in a downstream side of said transfer unit in a rotational direction of said image carrier and having a cleaning blade for scraping a residual toner left on said image carrier surface, the improvement in which said transfer unit is located on a portion of said image carrier such that an imaginary normal extending outward from said image carrier surface is directed upward with respect to a horizontal direction and said transfer unit transfers the toner image to a lower surface of the recording member; and said cleaning blade is brought into contact with a downward moving portion of said image carrier which has passed through said transfer unit at a contact angle of not less than 90° relative to the downstream portion of the carrier in a "with" contact state, and the residual toner scraped by said cleaning blade is moved downward along an upper surface of said cleaning blade.

2. An apparatus according to claim 1, wherein said image carrier comprises driving and driven rollers rotatably arranged in said main body and spaced apart from each other, and an image carrier belt looped around said driving and driven rollers and having said image carrier surface.

3. An apparatus according to claim 2, wherein said cleaning blade opposes one of said driving and driven rollers through said image carrier belt.

4. An apparatus according to claim 3, wherein said driven roller comprises a tension roller for applying a tension to said image carrier belt, said tension roller is located obliquely above said driving roller to obliquely drive said image carrier belt, and said cleaning blade opposing said tension roller through said image carrier belt.

5. An image forming apparatus for forming a toner image on an image carrier surface of a rotated image carrier, transferring the toner image to a lower surface of a recording member fed to a transfer unit, and bringing a distal end of a cleaning blade into contact with said image carrier surface side of said image carrier located in a downstream side of said transfer unit to remove residual toner from said image carrier surface, wherein said transfer unit is located on an image carrier portion defined such that an imaginary normal extending outward from said image carrier surface is directed upward with respect to a horizontal direction; said cleaning blade is brought into contact with an image carrier surface portion from a position where a direction of the normal extending from said image carrier surface is changed from an upward direction to a downward direction with respect to the horizontal direction to a position wherein the normal is directed vertically downward upon movement of said image carrier which has passed by said transfer unit; and said cleaning blade is located to satisfy the following inequality:

$$5^\circ \leqq \phi < \theta \leqq 90^\circ$$

when an imaginary horizontal plane extending outward from a contact portion of said image carrier surface which is in contact with said cleaning blade is defined as a reference, the normal extending from the contact portion of said image carrier surface forms an angle $\theta$ below the horizontal plane, and a contact line of said cleaning blade forms an angle $\phi$ below the horizontal plane.

6. An image forming apparatus comprising:

a main body;

first and second rollers mounted in said main body and having a predetermined distance therebetween;

a carrier belt looped obliquely between said first and second rollers and having an image carrier surface;

means for forming a toner image on said image carrier surface;

transfer means located near said image carrier and having a transfer unit for transferring a toner image formed on said image carrier surface to a recording member; and a cleaning blade one end of which is brought into contact with said image carrier surface below said transfer unit in a downstream side of said transfer unit in a rotational direction of said image carrier at a contact angle of not less than 90° relative to the downstream portion of the carrier surface in a "with" contact state, said cleaning blade being provided with an inclined upper surface extending obliquely downward from said one end to the other end thereof.

* * * * *